US008596729B2

(12) United States Patent
Sabelli

(10) Patent No.: US 8,596,729 B2
(45) Date of Patent: Dec. 3, 2013

(54) RELEASABLE TENON FOR LOCKING SYSTEM

(75) Inventor: Tonino Sabelli, Oakville (CA)

(73) Assignee: Wesko Systems Limited, Mississauga, Ontario (CA)

( * ) Notice: Subject to any disclaimer, the term of this patent is extended or adjusted under 35 U.S.C. 154(b) by 147 days.

(21) Appl. No.: 13/170,772

(22) Filed: Jun. 28, 2011

(65) Prior Publication Data

US 2011/0316397 A1 Dec. 29, 2011

(30) Foreign Application Priority Data

Jun. 29, 2010 (CA) ..... 2708700

(51) Int. Cl.
*E05B 65/46* (2006.01)

(52) U.S. Cl.
USPC ..... 312/219; 312/222; 70/78; 70/81; 70/83; 70/379 R; 70/380; 292/32

(58) Field of Classification Search
USPC ..... 312/215–217, 219–222, 107.5; 70/77–86, 379 R, 379 A, 380, 14, 32, 70/167–169, 210; 292/80, 32, 33
See application file for complete search history.

(56) References Cited

U.S. PATENT DOCUMENTS 969,776 A * 9/1910 Foley ..... 137/371
1,229,429 A * 6/1917 Foley ..... 137/371
2,677,261 A * 5/1954 Jacobi ..... 70/14
3,767,280 A * 10/1973 McLaughlin ..... 312/219
3,888,558 A * 6/1975 Himsl ..... 312/216
4,246,769 A * 1/1981 McLaughlin ..... 70/85
4,303,287 A * 12/1981 Taplin ..... 312/215
4,362,036 A * 12/1982 Shanklin ..... 70/167
4,527,407 A * 7/1985 Shanklin ..... 70/167
4,637,667 A * 1/1987 Reid et al. ..... 312/217
5,005,387 A * 4/1991 Cufr ..... 70/86
5,381,685 A * 1/1995 Carl et al. ..... 70/58
5,702,167 A * 12/1997 Muller ..... 312/221
5,772,294 A * 6/1998 Hendrich et al. ..... 312/221
5,802,891 A * 9/1998 Kahara et al. ..... 70/79

(Continued)

OTHER PUBLICATIONS

"Red River College Selects Three H's Multistations OS," Project Views, an excerpt from The Monday Morning Quarterback, Apr. 6, 2009, www.mmqb.com.

(Continued)

*Primary Examiner* — Darnell Jayne
*Assistant Examiner* — Ryan A Doyle
(74) *Attorney, Agent, or Firm* — Squire Sanders (US) LLP

(57) ABSTRACT

A locking system or a storage unit with the locking system, includes a locking core and a connected cammed lever. A user can rotate the core and lever about an axis when a latch is disengaged from a detent. When the latch is engaged with the detent, the core and the cammed lever are prevented from rotating about the axis. When the locking assembly is installed within the storage unit, the latch may be configured to strike a guide associated with a locking bar assembly, so that when the latch is moved to an unlatched position, the locking core and the lever are free to rotate, operating the locking bar between locked and unlocked positions. When the latch is withdrawn away from the guide, the latch engages with the detent to prevent movement of the lever and locking core relative to the locking assembly, to retain the lever and locking core in a desired, predetermined orientation.

20 Claims, 8 Drawing Sheets

(56) References Cited

U.S. PATENT DOCUMENTS

| | | | | |
|---|---|---|---|---|
| 5,823,643 | A * | 10/1998 | Feldpausch et al. | 312/221 |
| 5,839,803 | A * | 11/1998 | Lizell | 312/107.5 |
| 5,871,263 | A * | 2/1999 | Johnston et al. | 312/217 |
| 5,931,548 | A * | 8/1999 | Bischoff | 312/221 |
| 6,170,927 | B1 * | 1/2001 | Dykstra et al. | 312/220 |
| 6,722,167 | B1 * | 4/2004 | Hsu | 70/78 |
| 6,748,778 | B1 * | 6/2004 | Higdon et al. | 70/370 |
| 6,890,043 | B2 * | 5/2005 | Haworth et al. | 312/218 |
| 8,459,071 | B2 * | 6/2013 | Andersson | 70/210 |
| 8,485,005 | B2 * | 7/2013 | Tsai | 70/58 |
| 2002/0093274 | A1 * | 7/2002 | Jackson | 312/215 |
| 2003/0025425 | A1 * | 2/2003 | Cheng | 312/218 |
| 2003/0221465 | A1 * | 12/2003 | Westwinkel | 70/85 |
| 2012/0125057 | A1 * | 5/2012 | Mahaffey et al. | 70/14 |

OTHER PUBLICATIONS

Advertisement entitled "System 120," Timberline, pp. 8-9, www.timberlinelock.com.

* cited by examiner 51
59
61
73
71
70
57
75
55
65
63
67
68
82
80
85
89
87
86

RELEASABLE TENON FOR LOCKING SYSTEM

FIELD OF THE INVENTION

The invention relates to a locking system for use in association with multiple storage compartments and the like and to a storage unit incorporating at least one such locking system.

BACKGROUND

Storage equipment, office furniture, and other storage units and the like, containing multiple storage compartments often include locking mechanisms in which one or more sliding bars are configured to prevent unauthorized opening of storage compartments when the units are locked. The locking bars slide within a predefined path, between a locked position (in which the storage compartments are blocked from opening) and an unlocked position (in which one or more of the storage compartments are unlocked and may be opened).

In some instances, rotatable locks (sometimes called locking cylinders, or rotatable locking cores) are used in association with various mechanical systems to operate the locking bars between the locked position and unlocked position. However, certain prior art systems are prone to misalignment of the components of those locking systems during operation, so that it becomes difficult or impossible to properly reclose and lock the storage compartments after opening and operating one or more of the storage compartments.

It is desirable to have a locking system in which the lock (such as by way of example, a locking cylinder, locking core or similar component) is maintained in its proper position and orientation, so that the storage unit may be fully closed and all storage compartments may be locked when the storage compartments are returned to their closed positions.

SUMMARY OF THE INVENTION

A summary is provided below of some of the embodiments of the present invention including a locking assembly and a storage unit having multiple storage compartments. The following examples do not constitute an exhaustive list.

In one example, the present invention relates to a locking system for use in a multi compartment storage unit in which a locking core operates between a locked position and an unlocked position. When the locking core operates between the locked position and unlocked position, a lock bar operates between a corresponding locked position and a corresponding unlocked position.

The lock bar is configured to block all of the storage compartments in a corresponding array from opening when the lock bar is in its corresponding locked position. When the lock bar is moved to its corresponding unlocked position, one or more of the storage compartments in the corresponding array may be opened, to allow the operator to access the contents of each opened compartment.

This invention may be provided with anti-tip features, to prevent an operator from opening more than one drawer at one time, and thereby inhibit the storage unit from falling or tipping over when multiple compartments are simultaneously opened and extended. (Such anti tip features are not described in detail herein.)

In a preferred embodiment, the locking system comprises a rotatable locking core which acts upon a cammed lever (such as for example, a cammed tenon). In turn, the cammed lever acts upon the lock bar, operating the lock bar between the corresponding locked position and the corresponding unlocked position. In the preferred example, the cammed lever operates between three positions.

When the cammed lever is in its first position, the lock bar is in its corresponding locked position to prevent opening of the storage compartments.

When the cammed lever is in its second position, the lock bar is in its corresponding unlocked position, all of the storage compartments are unlocked but closed, and the cammed lever may be returned to its first position.

When a storage compartment associated with the locking system is opened, the cammed lever is moved from its second position to its third position, thereby preventing the cammed lever from returning to its second position until the storage compartment is closed.

In another embodiment, a locking assembly is provided for use in a storage unit. The locking assembly comprises the following features.

A rotatable cylindrical locking core is positioned within a housing. The locking core defines a horizontal axis. The locking core operates between a locked position and an unlocked position. A cammed lever operates between a first position when the locking core is in the locked position and a second position when the locking core is in the unlocked position. The cammed lever is provided to operate a lock bar assembly in the storage unit. The cammed lever also operates between the second position and a third position. The cammed lever comprises a latch operating between a latched position and an unlatched position. The latch may engage a detent to prevent movement of the cammed lever relative to the housing upon movement of the cammed lever from the second position to the third position. If a detent is provided, the cammed lever moves from the third position to the second position when the latch is released from the detent.

In another embodiment, the latch engages a detent when the cammed lever is moved from the second position to the third position. The detent may be defined by a recess, for example, a channel facing outwardly on an outer wall of the housing. In other configurations, the channel may be provided to face inwardly toward the longitudinal axis, for example, on an flange of the housing, adjacent to the latch bar.

In another embodiment, a locking assembly is provided for use in a storage unit. The storage unit may comprise a locking bar assembly associated with an array of multiple storage compartments. The locking assembly comprises the following.

A locking core is provided for rotational operation within a housing. The locking core rotates about a longitudinal axis extending along the length of the locking core. The locking core rotates between a locked position and an unlocked position.

A lever extends along the longitudinal axis. The lever is offset from the longitudinal axis. The lever rotates about the longitudinal axis upon rotation of the locking core. The lever comprises a latch bar moving between a first position in which the latch bar is engaged with a detent and a second position in which the latch bar is disengaged from the detent. In this first position, the latch bar prevents movement of the locking core relative to the housing. When the latch bar is in the second position, the locking core is able to move relative to the housing. In this embodiment, the latch bar disengages from the detent when the lever contacts the locking bar assembly, which, in turn, permits movement of the locking core between the unlocked position and the locked position.

The detent may be a channel defined on an outer wall of the housing. The latch bar may be biased for movement from the second position to the third position. A spring or some other suitable biasing element may be provided to urge the latch bar toward the third position, for engagement with the detent.

In some instances, the lever and the latch bar will be configured to engage with a guide provided on the locking bar assembly, so that when the lever and the latch bar are inserted into the guide, the latch bar is released from the detent, to permit movement of the lever from the second position to the first position, and to permit corresponding movement of the locking core from the unlocked position to the locked position. The guide may be configured as a pair of opposing posts, positioned in parallel, and projecting outwardly from a sliding lock bar in the locking bar assembly. In some instances, the lever and the latch bar may be configured so that when the lever is inserted between the pair of opposing posts, one end of the latch bar will disengage from the detent when the other end of the latch bar strikes one of the opposing posts.

This invention also includes a storage unit comprising multiple storage compartments and one of the foregoing locking assemblies in which the lever and the latch cooperate with the locking bar assembly so that the locking core will not move relative to the housing when the lever has moved from the second position to the third position. When the locking bar is in the second position, one or more of the storage compartments may be opened. The locking assembly provided in the storage unit may be associated with one of the storage compartments in an array of storage compartments in the storage unit. For example, the locking assembly may be mounted on the associated storage compartment, so that, when the associated storage compartment is opened, the lever will move from its second position to its third position. The locking core will be prevented from moving relative to the housing until the lever is returned to the second position and the latch bar is released from the detent.

Other embodiments of the invention will become apparent to those persons who are skilled in the art upon reading the following detailed description, drawings and appended claims.

IN THE DRAWINGS

DESCRIPTION

Figures 1, 2:
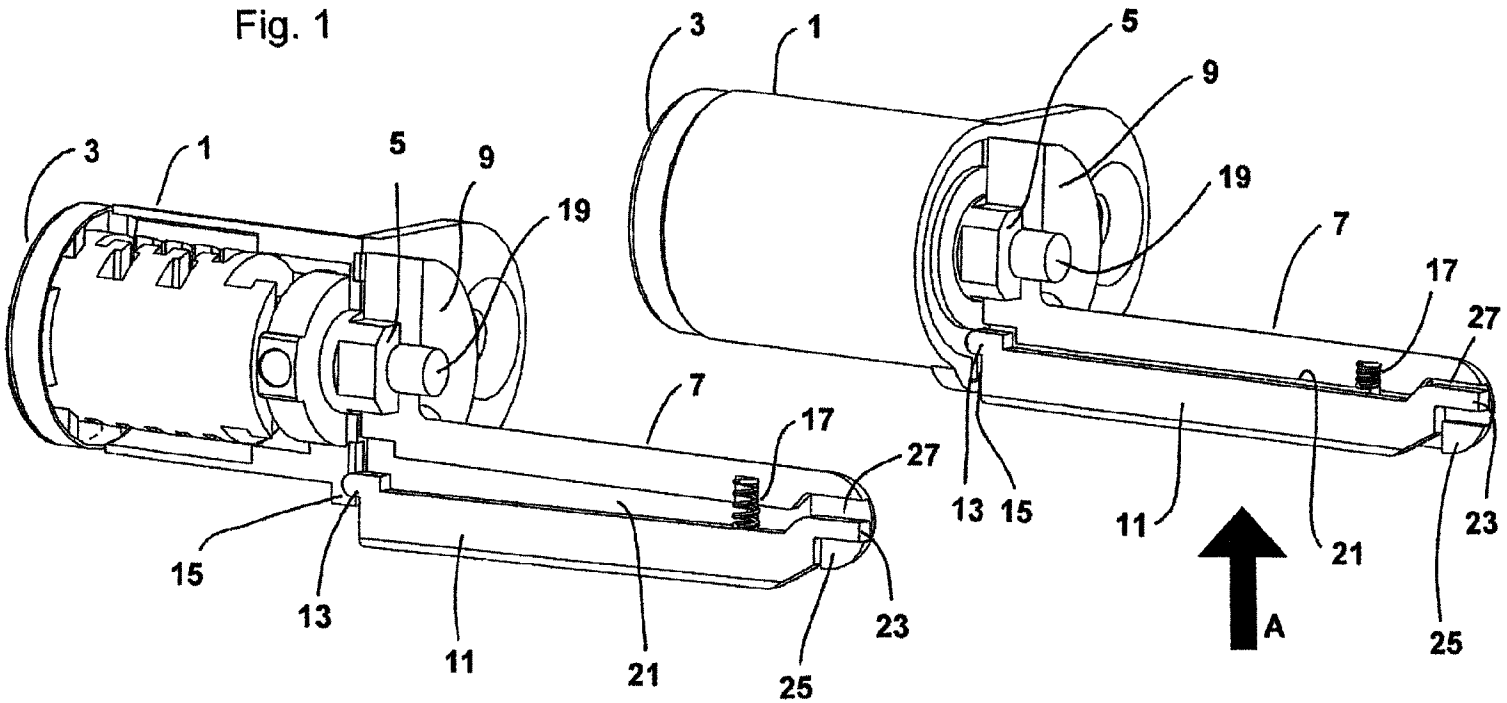
FIG. 1 and FIG. 2 are partial sectional views, in perspective, of a preferred embodiment of a locking assembly.

In a preferred embodiment as illustrated in FIGS. 1 and 2, a cylindrical locking core 3 is positioned for rotational operation within a lock housing 1. A driver 5 is secured to the locking core 3 and to the base 9 of cammed lever 7 so that upon rotation of the locking core 3, the cammed lever 7 will rotate about the longitudinal axis of the locking core. In this embodiment, the base 9 of the cammed lever 7 is fastened to the driver 5 using a fastener, such as a rivet, screw, threaded post or other suitable connector 19. The latch 11 comprises a latch pin 13 at a first end of the latch 11 and at the opposing end, the latch 11 comprises a retainer configured as a tongue 23. The tip 25 of the cammed lever 7 defines a cavity 27 to receive and retain tongue 23 of the latch 11. A spring 17 urges the latch 11 outwardly from channel 21 which extends along the cammed lever 7. As shown in FIG. 1, the latch 11 is biased outwardly so that latch pin 13 engages a detent, shown in this embodiment as a recessed stop 15. The recessed stop 15 faces inwardly from a flange extending from an outer wall of the lock housing 1. In this latched position, the cammed lever 7 and the locking core 3 are prevented from rotating relative to the lock housing 1, thereby, maintaining a desired orientation for the cammed lever 7 and the locking core 3, relative to the lock housing 1. (Persons skilled in the art will understand that the illustrated example of the locking assembly, including the lock housing 1, will be installed and secured to a storage unit, to co-act with corresponding components in a lock bar assembly within that storage unit.) The cammed lever 7 and the locking core 3 may be latched to prevent movement of the locking core 3 and cammed lever 7 relative to the lock housing 1, so that the locking assembly will remain in a desired orientation. The orientation of the locking core 3 and the cammed lever 7 may be changed after the latch pin 13 is released from recessed stop 15, when latch 11 is moved into channel 21, upon compressing spring 17, in the general direction illustrated by arrow A. In FIG. 2, the cammed lever is shown in an unlatched position. When the latch pin 13 is released, the locking core 3 may be rotated (to induce rotational movement of cammed lever 7) between a locked position and an unlocked position for the locking core 3.

Figures 3, 4, 5:
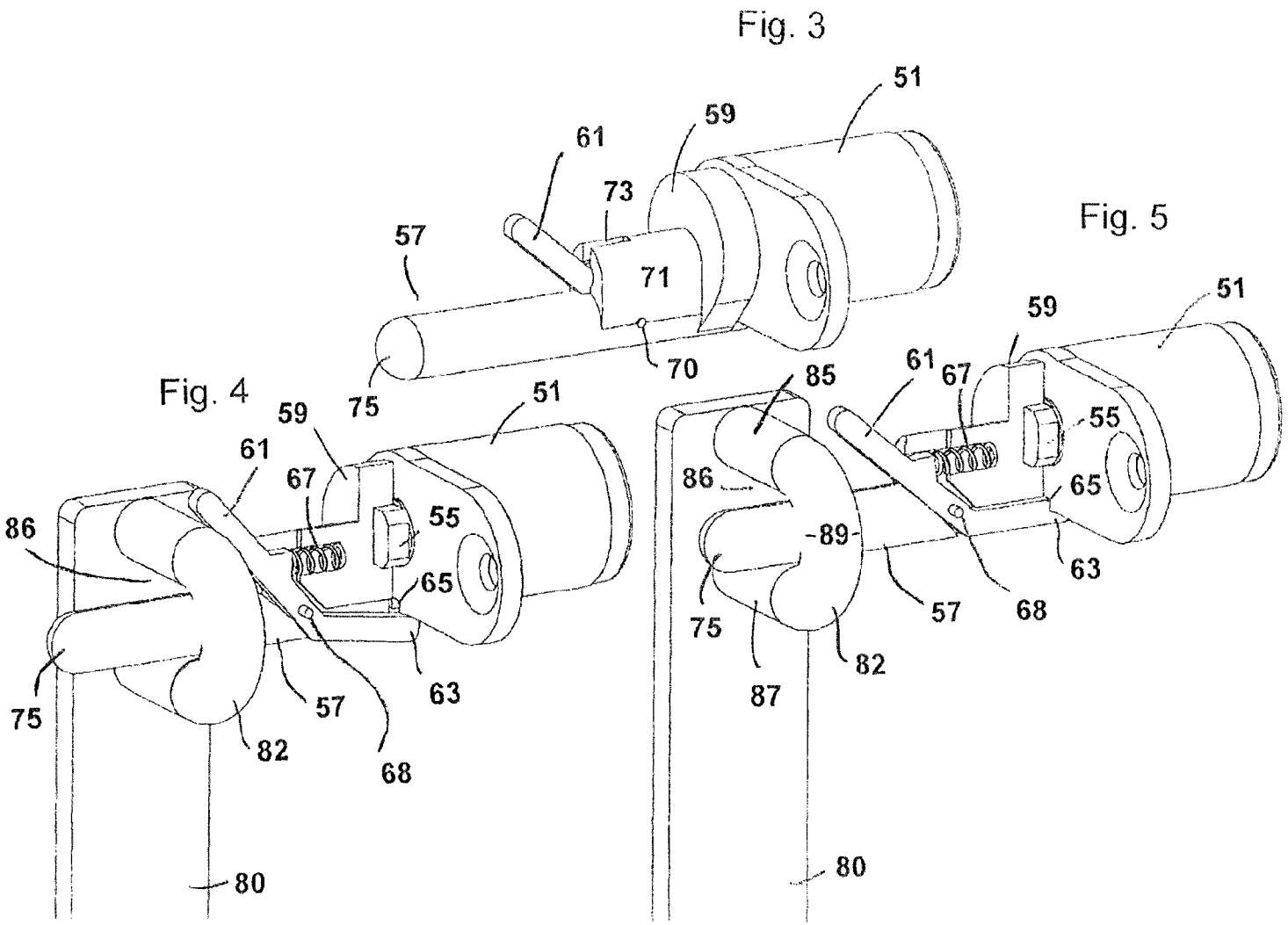
FIG. 3 is a side view, in perspective, of a second embodiment of the locking assembly.
FIGS. 4 and 5, are partial sectional views, in perspective, of the second embodiment of the locking assembly.

FIGS. 3, 4, and 5 illustrate another example of a locking assembly which may be used in a storage unit with multiple storage compartments, such as for example, drawers mounted on sliding bars. FIG. 3 shows an outer view of a locking assembly having a lock housing 51 which contains a rotatable locking core (not shown). The locking core defines a longitudinal axis about which the locking core and the cammed lever 57 may rotate. The locking core is secured to a driver 55 which is in turn secured to base 59 of the cammed lever 57. Rotational movement of the locking core will induce rotational movement of the cammed lever 57.

Striker arm 61 extends outwardly from cammed lever 57, along recess 73 extending along top cover 71. The latch, which comprises the striker arm 61 and the latch arm 63, pivots about latch pin 68 which is secured within bore 70. In FIG. 5, the latch is in the latched position, namely, latch arm 63 is positioned within a recessed stop 65. The striker arm 61 is urged outwardly by spring 67 which is mounted within top cover 71. As the tip 75 of the cammed lever 57 advances into an opening 86 defined by a coupling loop 82 on an associated locking bar 80, the striker arm will come in contact with a portion of the coupling loop 82. Eventually, by moving the cammed lever 57 into opening 86, the latch will be activated sufficiently to release latch arm 63 from recessed stop 65, to permit rotational movement of the cammed lever 57 and the locking core, relative to the lock housing 51. In the foregoing example, a coupling loop 82 was shown as an example of a guide which may be associated with a locking bar assembly, to operate the latch between a latched position and an unlatched position. By way of example, the loop 82 includes two opposing parallel post segments 85, 87 connected by an arched segment 89. A person skilled in the art will understand that a coupling loop 82 will guide the advancing lever tip 75 along two axes, as the lever tip 75 advances within opening 86. In some instances, it may be desirable to provide a guide having other features and configurations. For example, another suitable guide may include only two opposing parallel post segments 85, 87 (without arched segment 89). Persons skilled in the art will understand that other guides may also be used.

Also, in this example, the latch is shown as an angled bar having a latch arm 63 at one end which engages a recess, namely, a recessed stop 65. Other components with other shapes and configurations may be used to provide a latch suitable for maintaining the locking assembly in a desired orientation. For example, the latch may operate with another type of detent provided in the assembly, with the detent being preferably located on the lock housing.

It will be appreciated that in the embodiment illustrated in FIGS. 3, 4, and 5, the striker arm 61 of the latch does not enter the opening 86 along with the cammed lever 57. However, in the embodiment illustrated in FIGS. 1 and 2, the latch 11 and the cammed lever 7 would both enter into such an opening, so that the latch 11 would be moved inwardly, upon impact with an interior surface of a guide, such as for example, one of the posts in coupling loop 82. In either case, when the cammed lever (7 or 57) is withdrawn from the guide, the latch will engage with a detent to prevent movement of the locking core and cammed lever relative to the lock housing.

Figure 6:
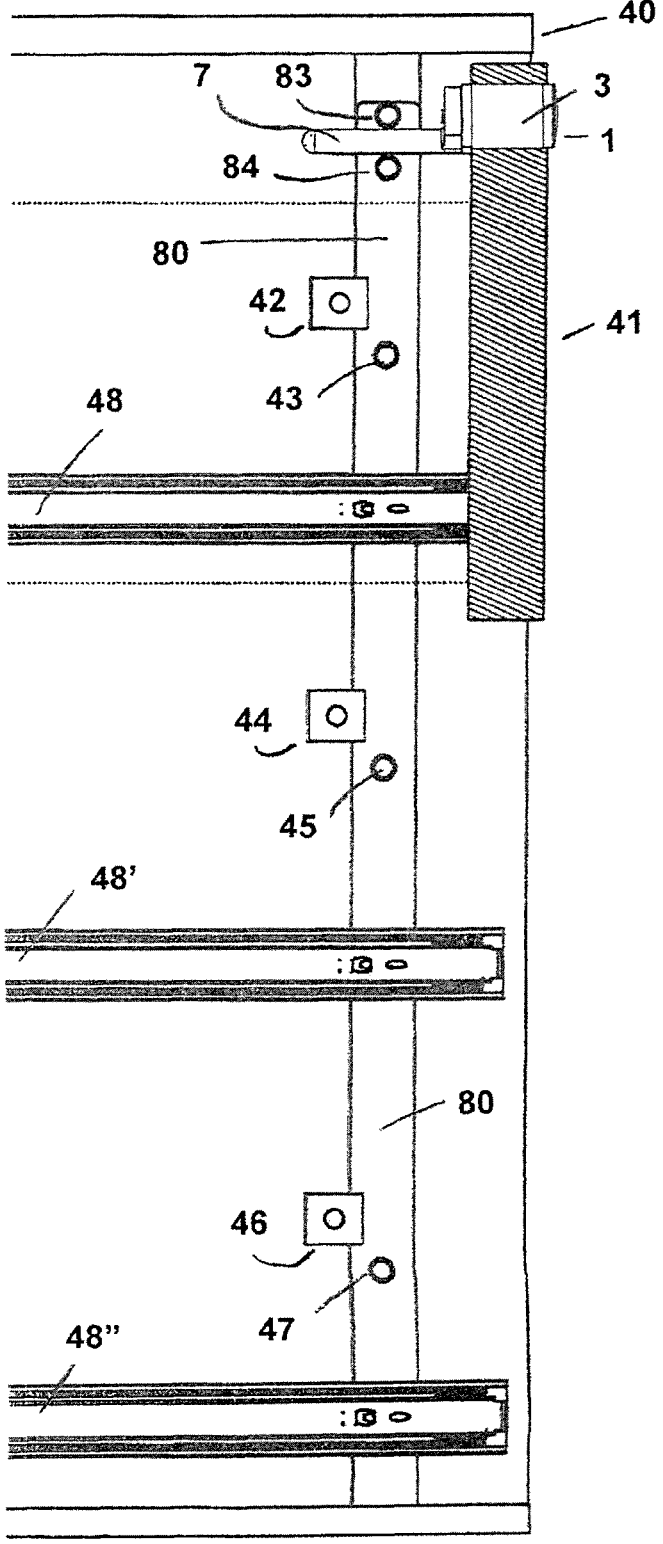
FIG. 6 is a sectional view of one side of a storage unit comprising a preferred embodiment of the locking assembly.
Figure 7:
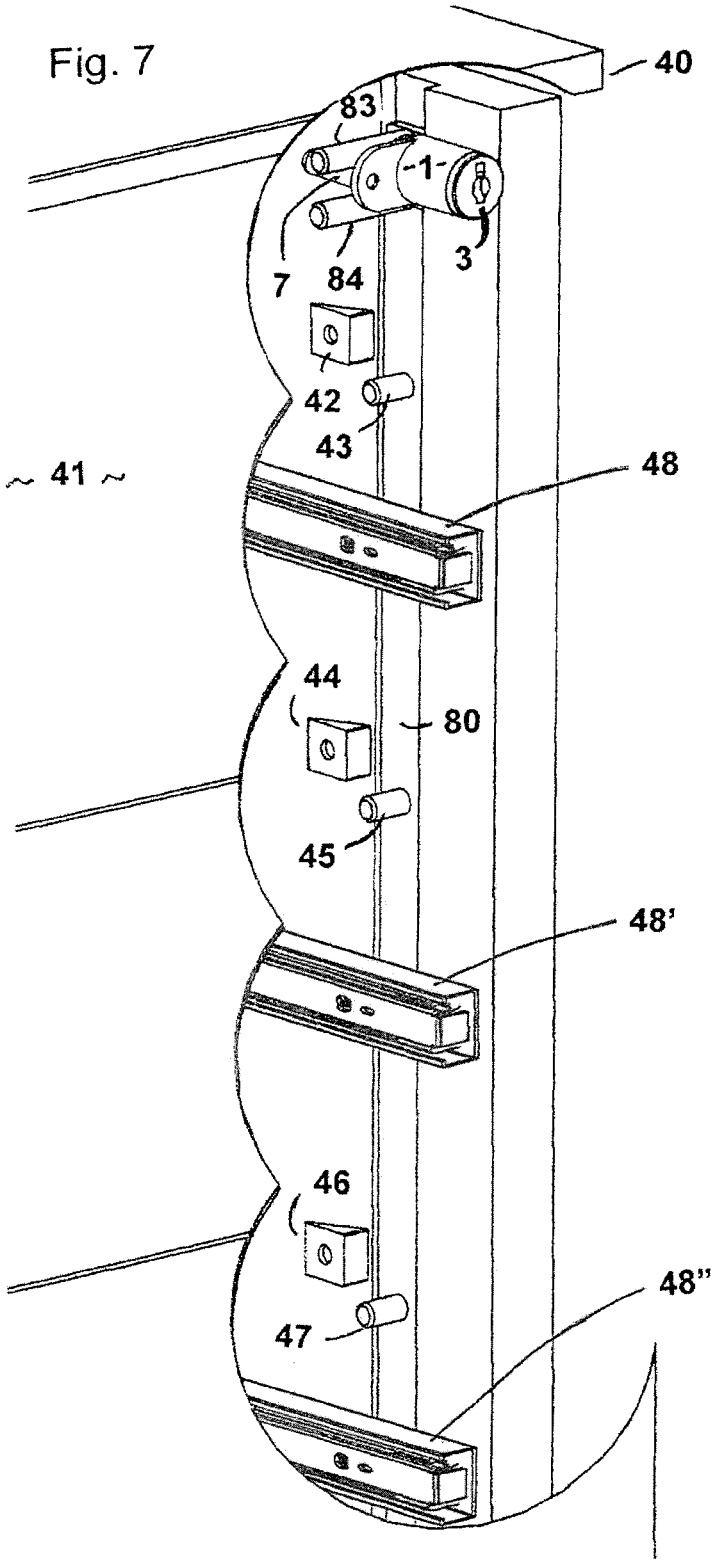
FIG. 7, is a partial sectional view, in perspective, of the storage unit shown in FIG. 6, in an unlocked position.
Figure 8:
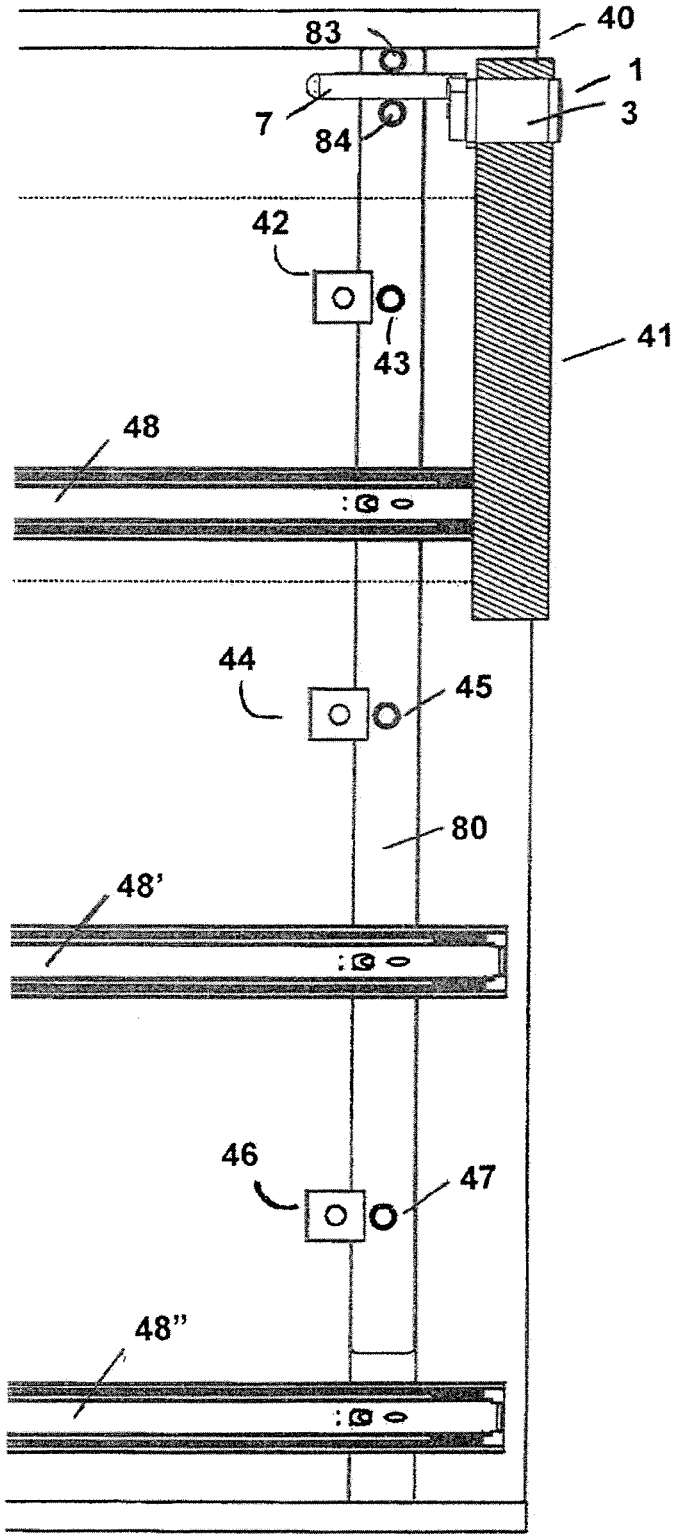
FIG. 8 is a sectional view of the storage unit shown in FIG. 6, in a locked position.
Figure 9:
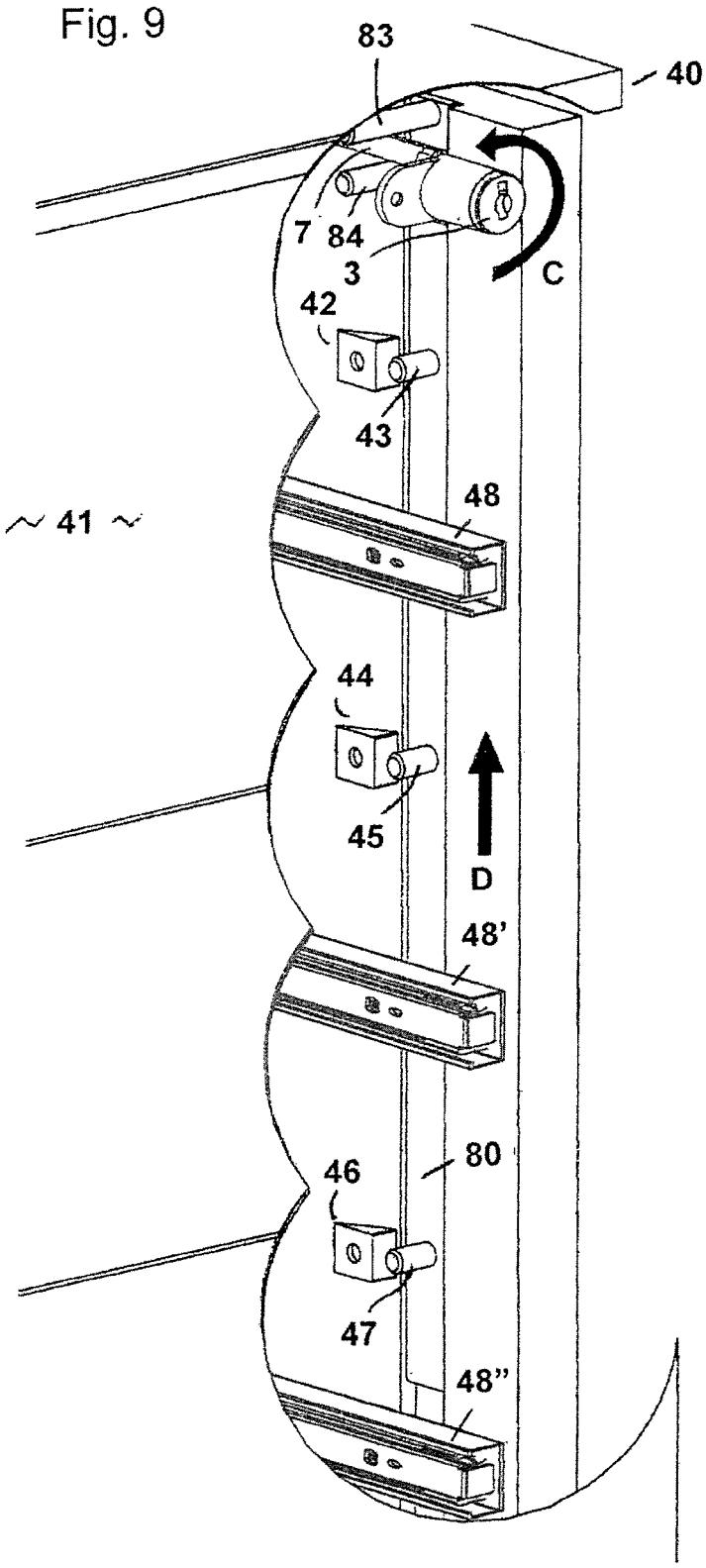
FIG. 9 is a partial sectional view, in perspective, of the storage unit shown in FIG. 8, in a locked position.

In FIGS. 6 and 7, a storage cabinet 40 is provided with a vertical array of drawers mounted on corresponding drawer slides 48, 48' and 48". Top drawer 41 and the two drawers mounted below (not shown in detail) are provided with corresponding blocks 42,44,46 which are fixed to their corresponding drawers. For example, block 42 is fixed to drawer 41. When a drawer is opened, its corresponding block is moved outwardly from the interior of cabinet 40, beyond locking bar 80. In this example, locking bar 80 is provided with a corresponding set of lock pins 43,45,47 which will align with corresponding drawer blocks 42,44,46 when the locking assembly is in the locked position and the locking bar 80 is elevated (as shown in FIGS. 8 and 9). In FIGS. 6 and 7, the locking assembly is in the unlocked position, the drawers are closed, and the locking bar 80 is lowered, to permit withdrawal of one or more drawers. In FIGS. 6 and 7, the cammed lever 7, the latch (not shown), and the coupled locking bar 80, are free to move between the locked and unlocked position. The cammed lever 7 may also be withdrawn from between the guide posts 83,84 when the locking bar 80 is lowered, to disconnect the cammed lever 7 from the guide posts, and thus allowing the latch to engage the detent. When the latch engages the detent, the cammed lever 7 (and the locking core 3) are prevented from moving relative to the lock housing 1. By fixing the orientation of the locking core 3 and the cammed lever 7 relative to the housing 1 which is in turn, fixed to the cabinet 40, an operator can more easily re-engage the cammed lever 7 with the locking bar assembly when the locking assembly (shown as mounted on drawer 41) is returned to the closed position, in the cabinet 40.

Rotational movement of the cammed lever 7 will result in corresponding vertical movement of the locking bar 80, when the cammed lever 7 is operatively engaged with guide posts 83,84. In FIG. 9, the locking core 3 is shown by arrow C as having been rotated in a counterclockwise direction. (In other embodiments, the same result will be obtained by rotation of the locking core in a clockwise direction.) When the locking core 3 is rotated in the direction of arrow C as shown, the locking bar 80 was raised in the direction of arrow D, into the locked position, with the lock pins 43,45,47 coming into corresponding alignment with blocks 42,44,46.

Figure 10:
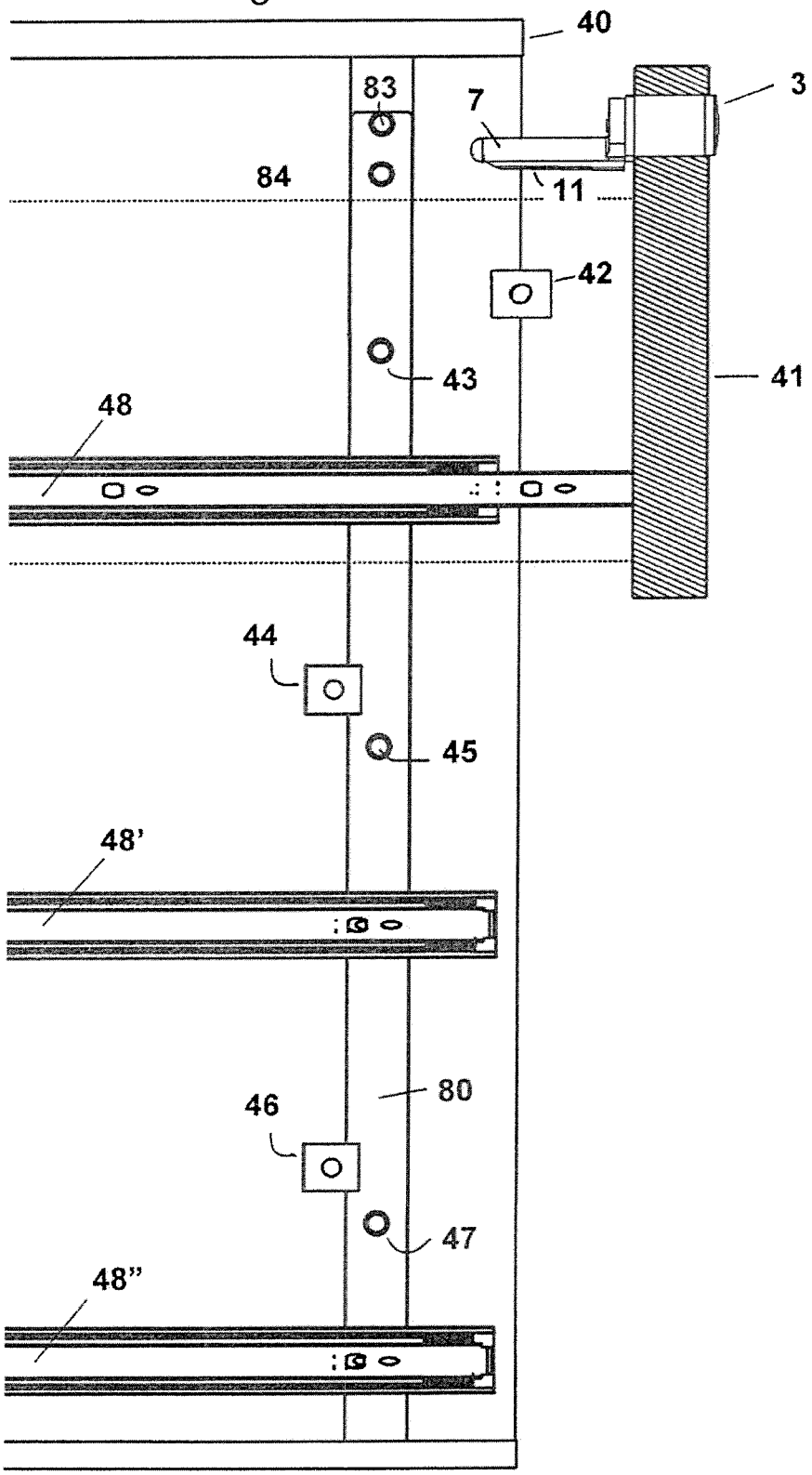
FIG. 10 is a sectional view of the above mentioned storage unit, in an unlocked position, with an opened storage compartment.
Figure 11:
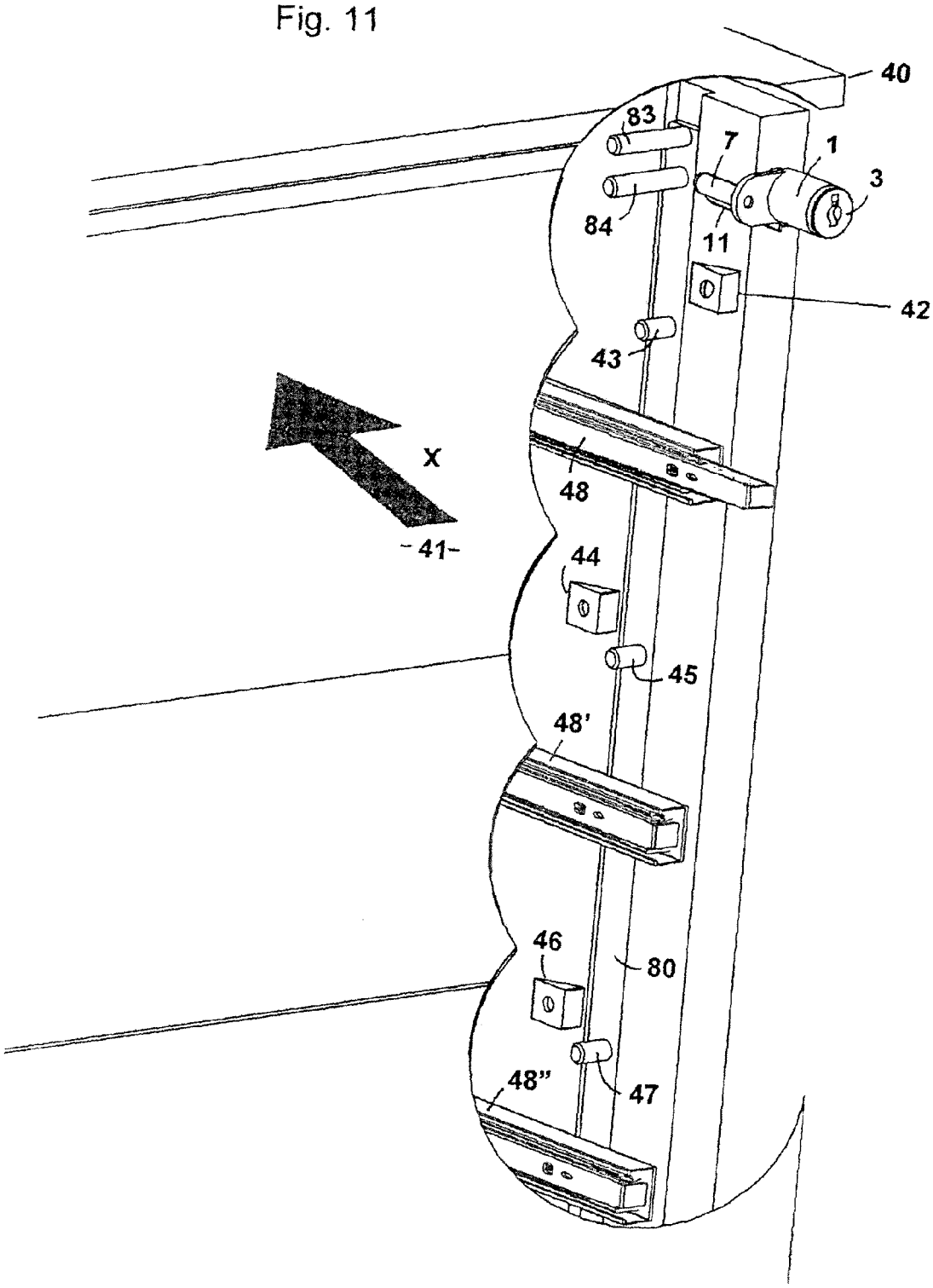
FIG. 11 is a partial sectional view, in perspective, of the storage unit shown in FIG. 10, with the opened storage compartment.

In FIGS. 10 and 11, the locking assembly is shown in the unlocked position, and the top drawer 41 is shown in an opened position, with the cammed lever 7 and the latch 11 being disengaged from the guide posts 83,84. In this orientation, the latch 11 is engaged with its corresponding detent, to prevent movement of the cammed lever 7 and locking core 3 relative to the lock housing 1. Locking bar 80 is in its lowered position, (in this case, corresponding to its unlocked position) with the lock pins 43,45,47 also being lowered, out of alignment with the corresponding blocks 42,44,46 fixed to their respective drawers. As illustrated in this example, lock pin 43 is out of alignment with drawer block 42 when locking bar 80 is lowered, allowing block 42 and drawer 41 (which is fixed to block 42) to move outwardly from locking bar 80.

As shown in FIG. 11, when drawer 41 is moved inwardly in the direction of arrow X, to close the drawer, the cammed lever 7 and the latch 11 approach the guide posts 83,84. Upon full closure of the drawer in the embodiment illustrated herein, the cammed lever 7 and the latch 11 will pass between the guide posts 83,84, engaging and moving the latch 11 inwardly, to release the latch from its corresponding detent. When the latch is released from the detent, an operator will be able to rotate the locking core 3 and the cammed lever 7, to thereby raise the locking bar 80 into a locked position, so that all drawers will be secured against opening.

Although certain examples of the latch, cammed lever, detent, guide, locking assembly, locking bar assembly, storage unit, and other elements of the invention have been illustrated, it will be appreciated that additional modifications and variations may be configured to ensure that a locking assembly is maintained in a desirable, predetermined orientation for continued operation in its working environment. Other modified embodiments of the locking assembly may be configured to prevent movement of the lever relative to the locking assembly. Other variations and modifications are also possible.

The foregoing examples include a preferred embodiment of the invention as described above. It will be apparent to those skilled in the art that additional embodiments are possible and that such embodiments will fall within the scope of the appended claims.

The invention claimed is:

1. A locking assembly used in a storage unit, the locking assembly comprising:

a rotatable cylindrical locking core within a housing, the locking core defining a longitudinal axis;

the locking core operating between a locked position and an unlocked position;

a cammed lever operating between a first position when the locking core is in the locked position and a second position when the locking core is in the unlocked position;

the cammed lever operating between the second position and a third position;

the cammed lever comprising a latch to prevent movement of the cammed lever relative to the housing upon movement from the second position to the third position; and the cammed lever is movable from the third position to the second position upon operation of the latch, wherein when the cammed lever is moved from the second position to the third position and the storage unit is opened, the cammed lever is thereby prevented from returning to the second position from the third position until the storage unit is closed.

2. In the locking assembly claimed in claim 1, the latch engaging a detent defined by the housing upon movement of the cammed lever from the second position to the third position.

3. In the locking assembly claimed in claim 2, the latch defining a latch bar engaging the detent when the latch bar and the cammed lever disengage from a locking bar assembly associated with an array of storage compartments in the storage unit, and the latch bar disengaging the detent when the latch bar and the cammed lever engage the locking bar assembly.

4. In the locking assembly claimed in claim 3, when the locking core is in the locked position, a block supported by each of the storage compartments in the array of storage compartments abuts against a corresponding pin projecting from the sliding lock bar to prevent opening of said each of the storage compartments.

5. A storage unit comprising:

the locking assembly claimed in claim 4;

said array of storage compartments; and said locking bar assembly, said block interacting with said corresponding pin to prevent opening of said array of storage compartments when the locking core is in the locked position.

6. In a storage unit comprising the locking assembly claimed in claim 3, each storage compartment in said array of storage compartments interacting with a corresponding pin projecting from the locking bar assembly, said corresponding pin blocking opening of said each storage compartment when the locking core is in the locked position.

7. In the locking assembly claimed in claim 1, the latch defining a first portion extending outwardly from the cammed lever for contact with a lock bar assembly in the storage unit upon operational movement of the cammed lever from the third position to the second position.

8. In the locking assembly claimed in claim 7, a second portion of the latch disengaging from the housing, upon operational movement of the cammed lever from the third position to the second position.

9. In the locking assembly claimed in claim 8, the second portion of the latch engages a detent defined by the housing to prevent movement of the cammed lever relative to the lock housing upon operational movement of the cammed lever from the second position to the third position.

10. In the locking assembly claimed in claim 1, the latch being configured as a latch bar extending away from a base of the cammed lever, the latch being biased for:

(a) movement outwardly away from a nesting position within the cammed lever, or (b) movement inwardly toward a nesting position within the cammed lever, upon operational movement of the cammed lever between the second position and the third position.

11. In the locking assembly claimed in claim 10, the latch returning to the said nesting position upon contact of the latch with a locking bar assembly associated with an array of multiple storage compartments in the storage unit.

12. In the locking assembly claimed in claim 1, the cammed lever extending along and offset from the longitudinal axis, the cammed lever rotating about the longitudinal axis upon rotation of the locking core; and the latch defining a latch bar moving between a first latch position wherein the latch bar is engaged with a detent, to prevent movement of the locking core relative to the housing, and a second latch position when the latch bar is disengaged from the detent, to permit movement of the locking core relative to the housing.

13. In the locking assembly claimed in claim 12, the latch bar disengaging from the detent when the lever contacts a locking bar assembly associated with an array of storage compartments, to permit movement of the locking core between the locked position and the unlocked position.

14. The locking assembly claimed in claim 13, configured for installation within an array of storage compartments and to prevent movement of the locking core relative to the housing upon disengagement of the lever and latch bar from the locking bar assembly.

15. In the locking assembly claimed in claim 14, the latch bar is urged from the detent when the latch bar and the cammed lever are inserted between a pair of parallel posts projecting outwardly from a sliding lock bar in the locking bar assembly.

16. In the locking assembly claimed in claim 12, the detent being a channel defined by the housing, the latch bar comprising:

a first portion configured to nest within the channel to prevent movement of the locking core relative to the housing; and a second portion to disengage the first portion from the channel upon movement of the second portion by the locking bar assembly.

17. In the locking assembly claimed in claim 16, a spring urges the latch bar for movement relative to the lever and to engage the detent.

18. In the locking assembly claimed in claim 12, the latch bar is biased to engage the detent.

19. A locking assembly used in a storage unit, the locking assembly comprising:

a cylindrical locking core rotatable within a housing about a longitudinal axis defined by the housing;

the locking core operating between a locked position and an unlocked position;

a cammed lever, extending along and offset from the longitudinal axis, operating between a first position when the locking core is in the locked position and a second position when the locking core is in the unlocked position;

the cammed lever comprising a latch to prevent movement of the cammed lever relative to the housing, upon movement of the cammed lever from the second position to a third position thereby engaging the latch with a detent;

wherein when the cammed lever is moved from the second position to the third position and the storage unit is opened, the latch is thereby prevented from disengaging the detent and the cammed lever is prevented from returning to the second position from the third position until the storage unit is closed.

20. The locking assembly claimed in claim 19, wherein the cammed lever rotates between the first position and the second position upon rotation of the locking core between the locked position and the unlocked position, and the latch comprises a pivoting latch bar which disengages the detent when the storage unit is closed and the cammed lever is returned to the second position from the third position.

* * * * *